United States Patent [19]

Egea et al.

[11] Patent Number: 4,827,693

[45] Date of Patent: May 9, 1989

[54] HOSIERY MANUFACTURE AND PACKAGING

[75] Inventors: Noel Egea; Corinne Olive, both of Le Vigan, France

[73] Assignee: Detexomat Machinery, Limited, High Wycombe, England

[21] Appl. No.: 73,018

[22] Filed: Jul. 14, 1987

[30] Foreign Application Priority Data

Jul. 21, 1986 [FR] France ..... 86 10860
Sep. 12, 1986 [GB] United Kingdom ..... 8621984

[51] Int. Cl.[4] ..... B65B 25/20

[52] U.S. Cl. ..... 53/397; 53/429; 53/474; 53/117; 53/156; 53/581; 223/41

[58] Field of Search ..... 53/397, 429, 474, 117, 53/156, 260, 581; 223/39, 41, 75

[56] References Cited

U.S. PATENT DOCUMENTS

| | | | |
|---|---|---|---|
| Re. 2,481 | 8/1987 | Hodges | 223/7 J |
| 622,741 | 4/1899 | Neller | 223/41 |
| 2,971,302 | 2/1961 | Berry | 53/581 |
| 2,989,178 | 6/1961 | Parker | 53/117 |
| 3,097,770 | 7/1963 | Garrou | 223/75 |
| 3,099,353 | 7/1963 | Berry | 206/278 |
| 3,166,223 | 1/1965 | Gazzaniga | 223/41 |
| 3,209,511 | 10/1965 | Fournier | 53/581 X |
| 3,486,471 | 12/1969 | De Spain | 223/75 |
| 3,826,062 | 7/1974 | Lewis | 53/255 |
| 4,440,329 | 4/1984 | Hodges | 223/43 |
| 4,550,868 | 0/1985 | Hodges et al. . | |

FOREIGN PATENT DOCUMENTS

| | | | |
|---|---|---|---|
| 493489 | 8/1977 | Australia | 53/117 |

*Primary Examiner*—John Sipos
*Attorney, Agent, or Firm*—Dority & Manning

[57] ABSTRACT

A pair of hose are mounted on a card for purpose of display or sale the card being inserted into one hose and the other hose being placed inside the first hose, between the latter and one surface of the card. Machinery for so assembling the hose and card has two supports and means to transfer a first hose from its support with eversion, to a holder in which a former is held. The second hose is everted by suction into its support and is then conveyed pneumatically into a hollow interior of the holding means, thereby placing it inside the first hose, to one side of the former. The former and the two hose assembled therewith are extracted from the holder, the first hose slipping from around the holder into an encircling relationship in contact with the former.

20 Claims, 4 Drawing Sheets

HOSIERY MANUFACTURE AND PACKAGING

Figure 1:
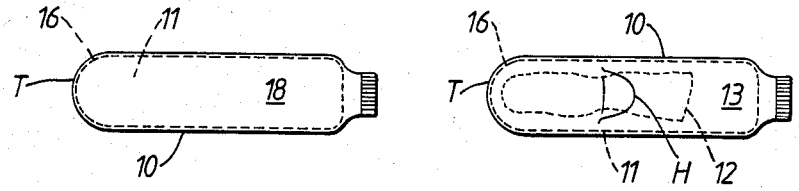
Figure 2:
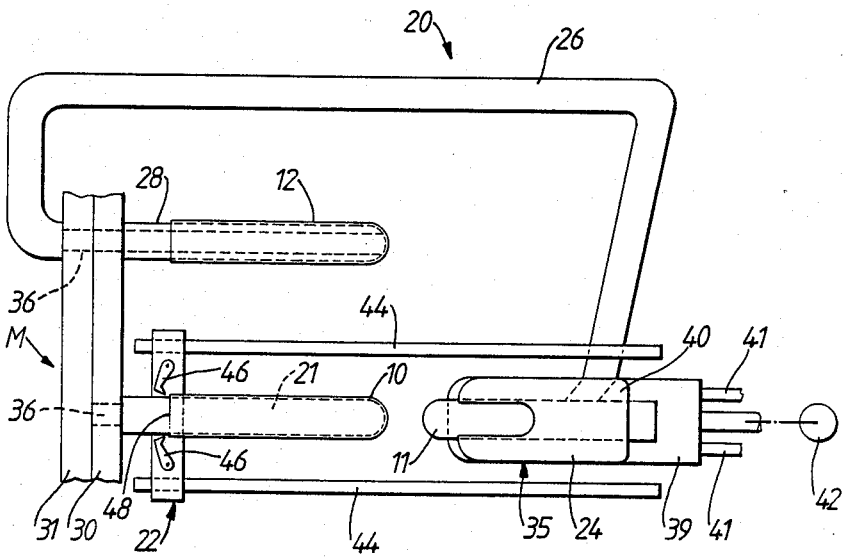
Figure 3:
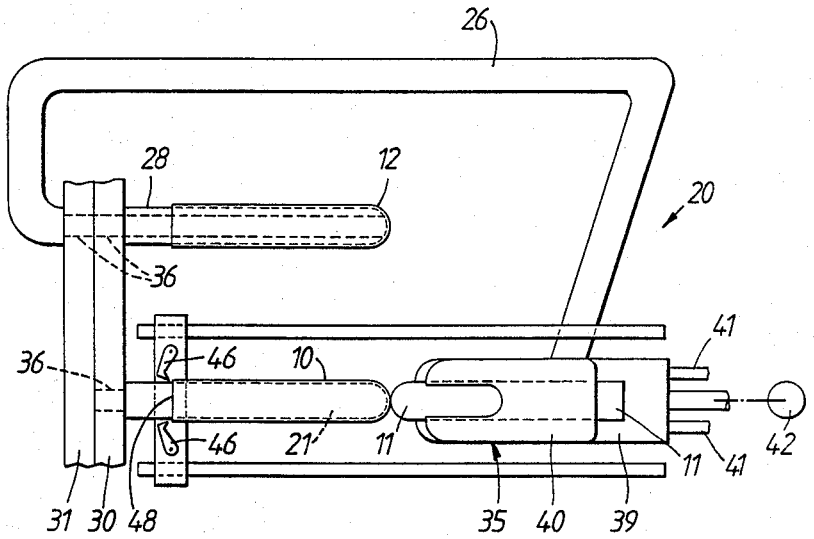
Figure 4:
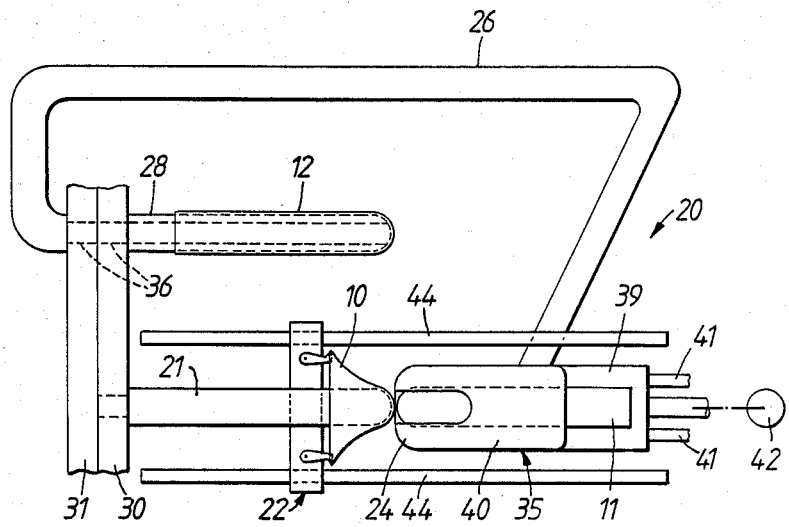
Figure 5:
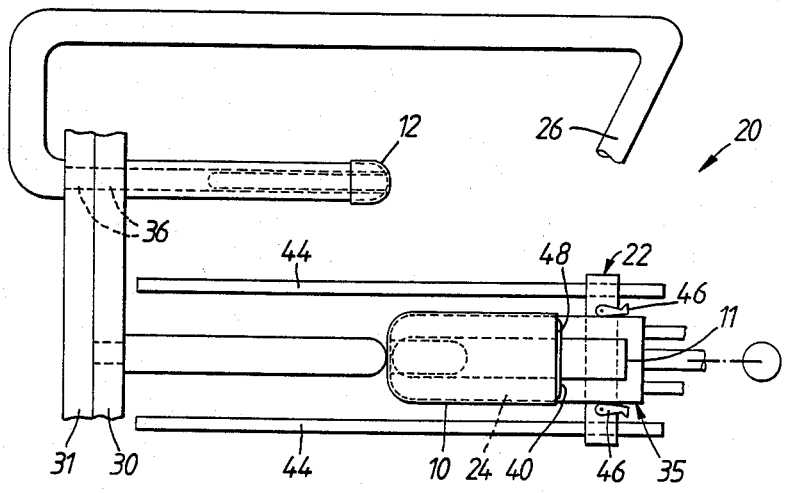
Figure 6:
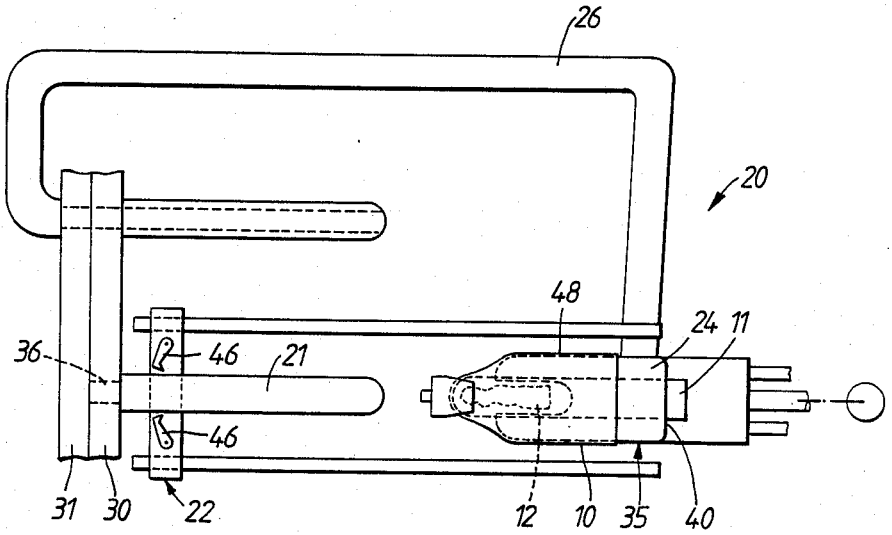

The present invention relates to improvements in hoisery manufacture and packaging; "hosiery" and "hose" means leg garments of full length, knee-length or ankle length.

There is a desire to present hosiery at point of sale in packaging which permits ready inspection of the hosiery, at least visually, by prospective purchasers. In some cases too, it may be desired that the hosiery is packaged so the prospective purchaser can feel the quality of the hosiery. More particularly, but not exclusively, these desires apply to patterned hosiery, for instance where the pattern in a single-colour hose is created by an appropriate manipulation of the knitting process.

It is known to mount finished hose individually on suitably stiff moulded plastics formers. Ordinarily, each hose is pulled onto its respective former by hand. This slow, laborious process is clearly unsatisfactory in an industry where production rates may be of the order of some hundreds of dozens of pairs of hose per working shift. There is, also a substantial risk of damaging otherwise perfect hose while mounting them on their formers.

Inter alia, this invention aims to devise a hosiery package and method of packaging which may avoid the need for formers individual to each hose of a pair of hose.

According to one aspect of the present invention, there is provided a pair of hose packaged for sale, wherein a first hose of the pair is stretched flat on and by a former inserted in that hose and a second hose is disposed inside the first hose, between one face of the former and a confronting layer of the first hose. The single former may be a card or like board stiff enough to keep the first hose stretched flat. It may be substantially as long as the first hose and may have a rounded end for engagement by the toe end thereof. The former could be folded or doubled to keep the size of the hosiery package within reasonable bounds, especially in the case of full hose of knee-length hose. If the former is significantly shorter than the hose, then parts of the hose that are unsupported by the former may be placed behind the former-supported portion of the hose so that one layer of this portion is exposed to view. After insertion of the second hose, the assembly may be wrapped inside a transparent wrapping if desired and/or the card could be folded in half and a band, e.g. of card, could be placed around the then-confronting toe and welt end of the card-supported first hose. Such a band could bear printed information helpful to the seller and/or purchaser.

Also according to the present invention, there is provided a method of packaging a pair of hose, wherein a first hose of the pair is mounted, preferably right-side out, on a flat former so as to be stretched laterally thereby, a layer of the first hose confronting one face of the former is separated from the said face to create an open space, into which the second hose of the pair is inserted, and thereafter the said layer of the first hose is permitted, or caused, to move toward the said face so as to entrap the second hose therebetween.

Before the first hose is mounted on the former, it and its companion hose may be in an inside-out state. Preferably, the first hose is everted to a right side out state, e.g. in the course of mounting it on the former and the second hose is everted and thereafter delivered into the said space created between the first hose and the former. For example, the second hose is everted by a suction everter and is delivered pneumatically into the said space.

Another object of the invention is to integrate the process with the operation of a hose processing machine. Accordingly, the two hose are supported internally by a pair of hose carriers of a hose processing machine, the former is moved into operative juxtaposition with one of the carriers which supports the first hose and the latter is transferred onto the former so as to be supported internally by the former, the second hose thereafter being dismounted from its carrier and inserted into the first hose between the latter and one face of the former. Usually, the former will be juxtaposed with the said one carrier such that former and carrier are alighned end-to-end, ends adjacent, and the first hose is stripped in a forward direction from the carrier across to the adjacent former and is drawn with eversion thereof onto the former.

The said machine can, for instance, be a toe closer, an inspection machine or a boarding machine.

Accordingly, the invention provides a method of finishing and packaging a pair of hose, starting with tubular hose blanks that are open at both their opposite ends, comprising closing toe ends of the two blanks, thereafter drawing a first of the toe-closed hose onto a flat former so as to be supported internally and stretched laterally thereby, preferably in a right side out state, creating a space between one of the layers of the first hose and one face of the former by separating the said one layer from the face, inserting the second toe-closed hose into the said space, and then permitting or causing the said one layer to move toward the said face of the former to entrap the second hose inside the first hose, thereby forming a hose package assembly comprising the first hose supported flat by the inserted former with the second hose located to one side of the former and inside the first hose.

The invention also seeks to provide apparatus for automatically providing a pair of hose packaged for sale. Accordingly, the present invention provides apparatus for packaging a pair of hose wherein one hose is stretched flat on a former and the other hose is located inside the first hose, comprising means to support the first hose in operative relationship to a flat former, means to transfer the first hose from the support means onto the former so as to closely encircle the former, means to separate one layer of the first hose temporarily from one face of the former, and means to deliver the second hose into the space created by the temporary separation of the said layer of the first hose from the former. Prefeably, the support means and former are disposed adjacent one another in general end-to-end alignment, and said transfer means is operative to load the first hose with eversion onto the former. By this means, said hose is mounted in a right-side out state on the former, even though it may have been inside-out on the support means.

In one embodiment of the invention, the transfer means is movable between the support means and the former and includes a hose-engaging element, the element being positioned and operable to engage a welt end of the first hose located on the support means, to remove the hose therefrom and to transfer the hose to the former and to mount it in an encircling position about the former.

In this embodiment, the apparatus includes means to hold the former in operative juxtaposition to the support means, and the transfer means is arranged to transfer the first hose onto both the former and the holding means so that the said hose encircles both. The holding means includes a hollow body configured to create the said space between the first hose and the former. The apparatus also includes means to grip an end of the former and the first hose, the gripping means and holding means being relatively movable to disengaging the holding means from the encircling first hose such that the latter slips from the holding means and closely encircles the former.

The support means can comprise inspection forms or boarding forms respectively of a hosiery inspection machien or hosiery boarding machine, or the leg supports or carriers of a toe closing machine.

A preferred embodiment of the invention is a hosiery finishing and packaging machine comprising in combination, a toe closer including two supports for a pair of hose to be toe closed, means to place a first of the supports and a flat packaging former in operative juxtaposition after toe closing of the first hose, the second support being adapted to evert the second hose by suction after toe closing thereof, a transfer mechanism and a conveying means, the transfer mechanism being operable to evert the first hose and place it in an encircling relationship on the former, the said mechanism being movable between the operatively-juxtaposed first support and the former and having a hose engaging element which is positioned and operative to engage a welt end of the first hose on the first support, to remove the first hose therefrom, to transfer it to the former and to mount it an encircling position on the former, the conveying means being arranged to deliver the everted second hose into a space temporarily formed between the first hose and one face of the former.

It will be appreciated that the foregoing finishing and packaging machine is meant to produce a pair of hose packaged for sale, as hereinbefore defined. The apparatus can be configured, adapted or operated such that the hose are mounted on individual formers such as cards, if such is desired, instead of placing one hose in a space between one face of the former and a confronting layer of the other hose.

Pairs of card mounted hose will then be gathered, mechanically or manually, for wrapping together to form a package. Alternatively, a pair of hose can be prepared for wrapping as a package by gathering one card-mounted hose and associating with it a second hose which is not mounted on a card; the second hose could, for instance, simply be laid upon the card-mounted companion of the pair.

For use in preparing packages of hose as just outlined, the invention also provides a hosiery finishing and packaging machine, such as a toe closer, having a suppoprt for a hose to be toe closed, means to place a flat packaging former in operative juxtaposition with the support for transfer of the hose from the support to the former, and a transfer mechanism operable to evert the hose and place it in an encircling relationship on the former, the transfer mechanism being movable between the operatively-juxtaposed toe closer support and the former and having a hose engaging element, the element being positioned and operative to engage a welt end of the hose located on the support, to remove the hose therefrom, to transfer the hose to the former and to mount it in an encircling position about the former, and means to deliver the former-mounted hose to another station for assembling it with another hose to make up a pair of hose.

In accordance with this aspect of the invention, there is provided a method of packaging hose, wherein a flat packaging former is juxtaposed with a hose mounted on a support of a hosiery processing machine, a transfer mechanism is operated to strip the hose from the support and mount it in a laterally-stretched condition encircling the former, and thereafter the hose mounted on the former is associated with another hose for packaging together as a pair. The outer hose need not be, but could be, mounted likewise on a packaging former individual thereto.

If desired, the other hose could be drawn over the first card-mounted hose such that the latter is contained within the other hose. In a method of producing such an arrangement, a flat packaging former and a first hose mounted on a support of a hosiery processing machine are juxtaposed for a transfer of the hose to the former, a transfer mechanism is operated to strip the hose from the support and mount it in a laterally-stretched condition encircling the former, and thereafter the former bearing the said hose and another hose mounted on a support of the machine are juxtaposed and the or another transfer mechanism is operated to transfer the other hose and mount it in a laterally-stretched condition encircling the first hose and the former therein.

Figure 7:
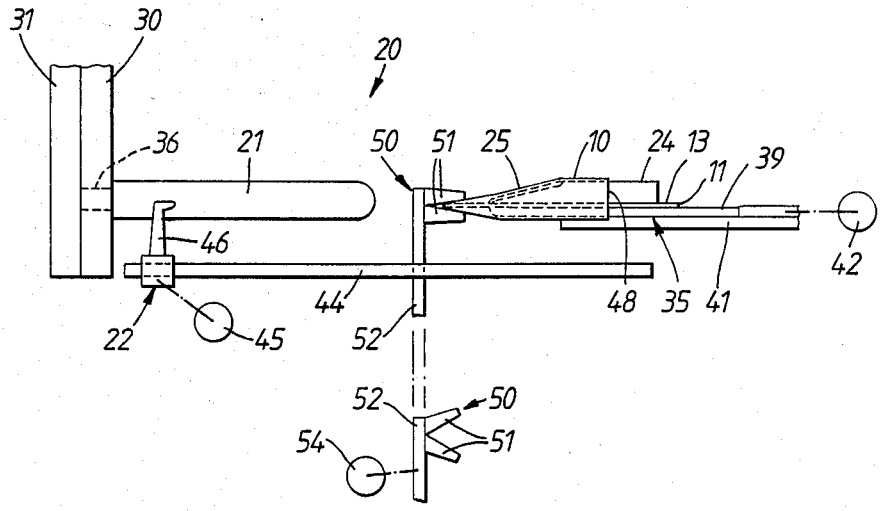
Figure 8:
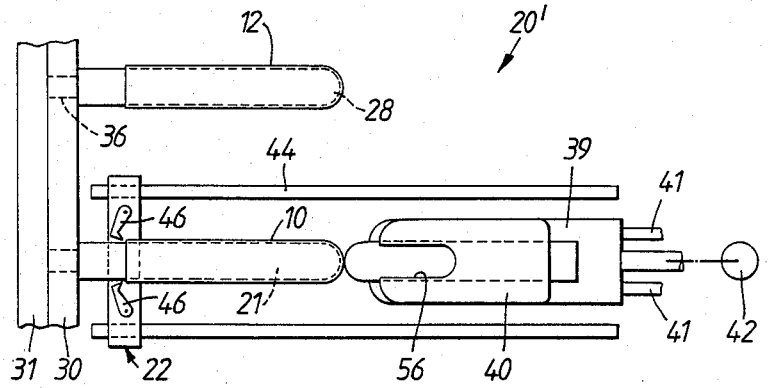

These and further aspects of the present invention will now be described in more detail by way of non-limitative example with reference to the accompanying drawings, in which:

FIG. 1 shows top and obverse views of a pair of hose packaged, according to the invention, for sale;

FIGS. 2 to 6 diagrammatically show top views of apparatus for performing the invention at different stages in its operation;

FIG. 7 diagrammatically shows a side view of the apparatus shown in FIGS. 2 to 6; and FIG. 8 diagrammatically shows an alternative embodiment of apparatus according to the invention.

The present invention is primarily concerned with finishing, and especially packaging, hose effectively in a manner suiting their inspection by prospective purchasers. To this end, a pair of hose is packaged using a relatively stiff backing former or card. The card is inserted in one of the hose and the companion hose is located between one surface of the card and a layer of the said one hose. The former is stiff enough to hold the said one hose flat and laterally stretched so that a layer thereof is clearly displayed for inspection.

FIG. 1 shows the pair of hose, the first hose 10 of the pair being stretched flat on and by the former 11 inside that hose. The second hose 12 is inside the first hose 10, between one face 13 of the former 11 and a confronting layer of the first hose 10. The former has a rounded end 16 for supporting a rounded toe T of the first hose 10, and is substantially as long as the first hose. The former can be shorter, longer or the same length as the first hose. As shown, the first hose 10 is mounted on the former such that its heel H confronts the face 13 of the former, the second hose being between this face and the lower or sole layer of the first hose. Since the first hose is stretched on and closely encircles the former, the second hose is securely retained with the first hose.

As stated hereinbefore, the pair of hose and former can be enclosed in a transparent wrapping not shown and/or can be folded in half lengthwise and kept folded by the wrapping or by a band, not shown. Howsoever the hose are finally packaged, a top surface 18 of the first hose is displayed clearly against a backing comprising the confronting face of the former 11.

The packaged hose shown in FIG. 1 could be assembled by placing the second hose 12 on the former 11 followed either by drawing the first hose 10 over them or by inserting them into the first hose.

The method preferred, however, involves mounting the first hose 10 on the former 11 so as to be stretched laterally thereby, the lower layer thereof confronting the face 13 of the former is separated from the said face to create an open space therebetween, and the second hose 12 is inserted into this space. Thereafter the said layer of the first hose 10 is permitted, or caused, to move toward the said face 13 so as to entrap the second hose therebetween. Tension in the fabric of the laterally-stretched hose 10 pulls the said layer towards the face 13 of the former 11.

If the two hose 10, 12 are initially in an inside out state, the first hose 10 is everted to a right side out state, preferably in the course of mounting it on the former. The second hose 12 is everted and thereafter delivered into the said space created between the first hose 10 and face 13 of the former 11. Conveniently, and as will be described hereinafter, the second hose is everted by a suction everter and delivered penumatically into the said space.

The preferred method just described lends itself well to performance by automatic apparatus shown schematically in FIGS. 2 to 7, to which reference is now made.

Broadly, apparatus 20 comprises means 21 to support the first hose 10 in operative relationship to the flat former 11, means 22 to transfer the first hose from the support means 21 onto the former 11 so as to closely encircle the former, means 24 to separate one layer 25 of the first hose temporarily from one face 13 of the former, and means 26 to deliver the second hose 12 into the space created by the temporary separation of the said layer of the first hose from the former.

The apparatus 20 also includes a second support means 28 for the second hose. Support means 21 and 28 are elongated members and are disposed adjacent and parallel to one another.

The support means 21, 28 which support the hose 10, 12 internally are parts of a hosiery processing machine M. The machine could be an inspection or boarding machine, but preferably is a toe closer.

The toe closer M can be of any type such as those manufactured and marketed by Detexomat Machinery Limited under the trade mark SPEEDOMATIC. See, for example, GB-B-No. 1,501,869, GB-B-No. 1,577,758 and GB No. 2,074,203. Full details of such toe closers are not given here since they are well known in the art, but a brief summary of such a toe closer follows.

In a preferred toe closer M, a pluraity of e.g. six, eight or ten hose support means, or leg carriers are mounted at intervals around a circular turret 30 which rotates upon a support 31 about a horizontal axis, the support means e.g. 21, 28 all projecting horizontally from a face of the turret. As the turret rotates, intermittently or continuously, the support means move around an endless path in turn visiting several stations. A first station I visited by the support means is a loading station, whereat open-ended hose blanks are mounted inside out manually or mechanically on the support means. At a second station II, the support means present toe ends of the hose blanks to a seamer such as a sewing machine. This produces a toe closing seam across the toe ends of the blanks. After seaming, the support means move to a discharge station III (shown in FIGS. 2 to 7) whereat the toe closed hose are stripped from the toe closer and assembled with the former 11. After removal of the hose from their support means at station III, the said means move back to the loading station I for receiving new hose blanks for processing.

The support means include suction tubes connectible through ports 36 in the turret 30 and support 31 to a source of suction. The tubes are exposed to suction at loading station I. Support means 28, but not 21, has its tube connected to suction at station III.

At station III, the support means 21 is located in suitable alignment with means 35 which hold the former 11 and present it suitably to support means 21 for transfer of the first hose 10 to the former. The support means 28 has its hollow tube connected to aligned ports 36 in the turret 30 and its support 31 for suction to be generated in the tube at the appropriate time. Suction is used to strip the second hose 12 off support means 28 and evert it into its tube; after eversion, the second hose leaves the tube and enters conveying means 26 for pneumatic delivery into the first hose 10.

In this embodiment, the former holder means 35 comprise an elongated plate 39 and a hollow body 40 having an upper surface serving as the means 24 for separating the hose layer 25 from surface 13 of the former. The former 11 is inserted, or sandwiched, and gripped between the plate 39 and the hollow body. The holding means 35 comprising plate 39 and body 40 is movable towards and away from support means 21 at the discharge station. Suitable guide means 41 and drive means 42 are provided for controlling the movement of the holding means 35.

When support means 21 with a toe-closed hose 10 thereon arrives at station III, holding means 35 moves toward the support means 21. This is to dispose the support means 21 and former 11 adjacent one another in general end-to-end alignment, see FIGS. 2 and 3. This movement brings the rounded end of the former 11 into engagement with the toe end of the hose 10 on the support means 21.

A continued movement of the holding means 35 then causes the plate 39 and body 40 to slip along the now-arrested former 11 until corresponding ends of the plate 39 and body 40 are adjacent or in contact with the hose toe end. See FIG. 4. Upon arrival of the holding means 35 in this position, control means (not shown) renders the transfer means 22 operative to load the first hose 10 with eversion onto the former 11. The transfer means 22 is movable along guide means 44 by a drive means 45 and in this case includes two hose-engaging elements 46. The elements 46 are positioned and operable first to engage a welt end 48 of the first hose 10 located on the support means 21, then to remove the hose therefrom as the transfer means moves rightwards along the guide means 44. During continued rightwards movement, the transfer means 22 transfers the hose and mounts it in an encircling position about the holding means 35 and the former 11 held thereby. See FIG. 4 which illustrates an early stage in the operation of the transfer means, and FIG. 5 which shows the transfer means moved beyond and clear of the welt end of the hose now disposed about the holding means and the former.

It will be appreciated that the operation of the transfer means 22 is such as to transfer the hose 10 with eversion from the support means 21 to the former which, at present, is located in the holding means 35. Due to tension in the fabric of hose 10 and the fact that it is stretched open as it is passed over the former 11 and the holding means 35, when the hose is released from the hose engaging elements 46 it closely encircles holding means 35.

As noted above, the hollow body 40 of holding means 35 has an upper surface 24 spaced clear of the top surface 13 of former 11. When the hose 10 is in position encircling the holding means 35, its layer 25 is spaced from the former suitably for receipt of the second hose 12.

At an appropriate time during or following completion of the transfer of hose 10, suction is generated in the suction tube of support means 28. The suction causes eversion of hose 12 into the suction tube. Thereafter, conveying means 26 is operated to convey the everted hose 12 pneumatically to the holding means 35. The conveying means 26 is a duct which is connected between the two closer and the hollow body 40 of the holding means 35. The second hose 12 is then blown into the hollow body 40. The latter has an opening at its front end so that hose 12 can be blown to the toe end of the hose 10.

Once the second hose 12 has been thus assembled with the first hose 10 and the former 11, all that remains is to disengage the former with the two hose from the holding means. To this end, the apparatus includes means 50 to grip an end of the former 11 and the first hose 10. The gripping means and holding means 35 are relatively movable to disengage the holding means 35 from the encircling first hose 10 such that the latter slips from around the holding means 35 and closely encircles the former 11.

As shown in FIG. 7, the gripping means 50 includes two jaws 51 mounted to a vertically movable stem 52 so as to adopt open or closed positions. The gripping means 50 is located below the path of movement of the holding means 35 except when the hose 10, 12 and former 11 are being disengaged from the holding means. To disengage the hose and former, the gripping means 50 is raised by a drive means 54, with the jaws open. When the jaws 51 are level with the front of the holding means, they are closed to grip the toe of the first hose 10 and the rounded end of the former 11. The opening 56 at the front of the hollow body 40, and a suitable configuration or positioning of the plate 39, enable the jaws to grip the first hose and former. Once the jaws 51 are closed, the holding means 35 is driven away from the gripping means 50 by drive means 42. The holding means is driven rightwards, i.e. away from the toe end of hose 10 and the rounded end of former 11. As it is moved, the first hose which encircled the holding means 35 slips therefrom and collapses around the former 11. Due to the width of the former relative to the girth of the first hose, the latter is laterally stretched on the former 11. Ultimately, the former and hose 10, 12 are disengaged fully from the holding means, whereupon the gripping means 50 can be lowered by drive means 54 and its jaws opened to release the packaged pair of hose.

If desired, plate 39 of the holding means could be omitted, provided with hollow body 40 is furnished with means to hold the former 11.

The equipment shown in FIGS. 1 to 7 serves as a hosiery finishing and packaging machine comprising a toe closer including at least two supports 21, 28 for a pair of hose 10, 12 to be toe closed, means 35 which place a first 21 of the supports and a flat packaging former 11 in operative juxtaposition after toe closing of the first hose, while the second 28 ovf the supports is adapted to evert the second hose by suction after toe closing thereof. The machine includes a transfer mechanism 22 and a conveying means 26, the transfer mechanism 22 being operable to evert the first hose and place it in an encircling relationship about the former. The said mechanism is movable between the operatively-juxtaposed first support and the former and has a hose engaging means 46 positioned and operative (a) to engage a welt end 48 of the first hose 10 on the first support 21, (b) to move the first hose from the support (c) to transfer it to the former and (d) to dispose it in an encircling position around the former 11. The conveying means 22 is arranged to deliver the everted second hose 12 into a space temporarily formed between the first hose 10 and one face 13 of the former 11.

The apparatus disclosed hereinbefore is based on a toe closer having supports for the hose, but equally it could be based on an inspection machine or a boarding machine, or indeed on any hosiery processing machine having supports for hose which are suitable for coaction with a transfer mechanism.

As described above, the hose 12 delivered pneumatically into the space inside hose 10 is derived from support 28 alongside support 21 on which hose 10 was previously mounted. If desired support 28 could be part of a second hosiery processing machine which is operated in conjunction with a first hosiery processing machine that is fitted with the transfer mechanism 22, the former holding means 35 and the components allied therewith. Conveying means 26 will then extend from the second machine to the holding means 35. Such an arrangement may suit some hosiery manufacturers and may be a convenient way of achieving optimum production rates.

It may be desired to mount the hose 10, 12 each on separate formers 11 individual thereto. The apparatus 20' shown in FIG. 8 is the above-described apparatus adapted for this purpose. In essence, apparatus 20' omits the facility to evert hose 12 and the pneumatic conveying means, or said facility and conveying means are disabled. In use of apparatus 20', each support in turn is located in operative juxtaposition to the holding means 35 and a former held thereby. The hose on each support is then transferred to the holding means 35 and former 11, and the former 11 is thereafter disengaged from the holding means, all as described above. Once the first hose 10 is thus mounted on its former, the operation is repeated to place the second hose 12 on its former.

Thereafter, the former-supported hose can be discharged and incorporated into packages with suitable wrappings.

For example, pairs of hose—each mounted on a former—can be assembled, manually or mechanically, and wrapped for easy inspection. Alternatively, a former-mounted hose can be associated with a companion hose to form a pair, the companion hose being in its limp, unmounted state. The companion hose may be simply laid on the former-mounted hose. The companion hose can be processed on the same machine as the hose that is mounted on the former, or on another machine in the hose manufactory. Clearly, a package can readily be produced with the former-mounted hose presenting a single layer thereof to view for easy inspection by a customer.

By way of another example, the companion hose could be drawn over the first, former-mounted hose so that both hose are in a laterally-stretched, flat condition encircling the one former. Probably most conveniently, such an arrangement is assembled on a single hosiery processing machine such as a toe closer apparatus 20', when a former will be fed to and engaged with the holding means 35 for every other hose brought into juxtaposition with the holding means 35. The same transfer mechanism will, normally, be used for successively mounting the two hose of a pair on the former.

Therefore, the apparatus of FIG. 8 could be adapted, if desired, so as to place the second hose 12 in an encircling, mounted position about the first hose 10, after the latter has been mounted on the former 11. Before disengaging the first hose and former from the holding means 35, the support carrying the second hose 12 and the hose-carrying former are brought into juxtaposition. A transfer mechanism, which e.g. is the same mechanism 22 employed for mounting the first hose 10 on the former 11, is then activated to transfer the second hose and mount it about the first hose 10 and the former 11 therein. The former 11 now bearing the successively mounted first and second hose 10, 12 is then disengaged from the holding means. A pair of hose, so mounted, can then be wrapped in a way permitting easy inspection of the nature and quality of the hose.

The apparatus disclosed above is particularly beneficial when associated with a toe closer, since the apparatus everts the hose in the performance of the method. In some cases, it may not be necessary to evert the hose. Non-everting apparatus can readily be devised by those skilled in the art. For example, the transfer means 22 could first strip the hose from support 21 in a forward or toe direction as described. Then, the transfer means could move into operative juxtaposition with a former 11 disposed, for instance, generally alongside the support 21. The transfer means 22 could then be caused to make a return or rearward movement so as to don the hose welt first about the former.

There may be a call for hosiery to be sold in units comprising more than a pair, e.g., in packages comprising two pairs. For example, two pairs could be assembled using the apparatus 20 by adapting or rendering the apparatus operable to mount one hose 10 on a former and then to deliver three successive hose 12 into the space created temporarily between hose 10 and the former. Alternatively, with each former-mounted hose obtained from apparatus 20', can be associated a plurality of limp, unmounted companion hose, the latter e.g. being processed on other hosiery machines and delivered to an appropriate location for assembly with the mounted hose.

It will be appreciated that the apparatus has only been disclosed schematically and only in such detail as will enable the ordinary skilled addressee to understand its operating principles. Apparatus actually constructed to operate according to this invention may, therefore, bear little physical resemblance to the illustrated apparatus.

We claim:

1. A method of finishing and packaging a pair of hose, starting with tubular hose blanks that are open at both their opposite ends, comprising closing toe ends of the two blanks, thereafter drawing a first of the toe-closed hose onto a flat former so as to be supported internally and stretched laterally thereby in a right side out state, creating a space between one of the layers of said first hose and one face of said former by separating said one layer from the said face, inserting the second toe-closed hose into said space, and then permitting or causing said one layer to move toward said face of the former to entrap said second hose inside the first hose, thereby forming a hose package assembly comprising said first hose support flat by the inserted former with said second hose located to one side of said former and inside said first hose.

2. A method according to claim 1, wherein said blanks are toe closed sequentially while supported, inside out, internally by a pair of carriers of a toe closer, at least the carrier of said second blank being operable as a suction everter, said former is placed with one end adjacent a free end of the carrier supporting the first blank in a lengthwise alignment with that carrier, a welt end of said first toe-closed hose is moved forwardly relative to the carrier to strip the hose therefrom, convey it across to the adjacent former and draw it with eversion onto the former, suction is generated at the other carrier to strip said second hose therefrom with eversion, and said everted second hose is delivered into said space created between the former and the said one layer of the first hose.

3. A method according to claim 1, wherein said former is engaged by a holding means therefor and said first hose is drawn over the holding means and the former, said holding means including a hollow body configured to create said space between a layer of said first hose and said former, the second hose is delivered into said hollow body and said space, and thereafter the former is disengaged from said holding means in such a manner that said first hose encircling the holding means slips therefrom and closely encircles said former.

4. A method according to claim 3, comprising disengaging the former from said holding means by clamping and immobilizing an end of said former whereat a toe end of the first hose is located, and moving said holding means away from said end of the former.

5. Apparatus for packaging a pair of hose wherein one hose is stretched flat on a former and the second hose is located inside the first hose, comprising hosiery processing machinery for performing a finishing operation on the hose, hose carriers of said machinery being located to support at least said first hose in operative relationship to a flat former, means to transfer said first hose from its associated carrier onto said former so as to closely encircle the latter, means to separate one layer of said first hose temporarily from one face of the former, and means to deliver said second hose into the space created by the temporary separation of the said layer of the first hose from the former.

6. Apparatus according to claim 5, wherein said machinery comprises a toe closer and said associated carrier and former are disposed adjacent one another in general end-to-end alignment, said transfer means being operative to load said first hose with eversion onto the former.

7. Apparatus according to claim 6, wherein said transfer means is movable between said associated carrier and the former and includes a hose-engaging element, said element being positioned and operable to engage a welt end of the first hose located on said carrier, to remove the hose therefrom, to transfer the hose to said former and to mount it, everted, in an encircling position about the former.

8. Apparatus according to claim 6, including means to evert said second hose and pneumatic means to deliver the everted second hose into said space.

9. Apparatus according to claim 5, further comprising means to hold said former in juxtaposition with said support means, said transfer means being arranged to transfer the first hose onto both said former and said holding means whereby said hose encircles both, and said holding means includes a hollow body configured to create said space between the first hose and said former.

10. Apparatus according to claim 9, wherein said hollow body is connected to means for delivering the second hose into its interior.

11. Apparatus according to claim 9, further including means to grip an end of said former and the first hose, said gripping means and said holding means being relatively movable to disengage said holding means from the encircling first hose such that the latter slips from said holding means and closly encircles the former.

12. Apparatus according to claim 5, wherein the first and second hose are mounted on individual carriers which comprise inspection or boarding forms of a hosiery inspection or hosiery boarding machine.

13. A hosiery finishing and packaging machine comprising, in combination, toe closing equipment including two carriers for a pair of hose to be toe closed; means to place a first of said carriers and a flat packaging former in operative juxtaposition after toe closing of the first hose; said second carrier being adapted to evert the second hose by suction after toe closing thereof; transfer means and a conveying means; the transfer means being operable to evert said first hose and place it in an encircling relationship on said former, said transfer means being movable between the operatively-juxtaposed first carrier and the former and having a hose engaging element which is positioned and operative to engage a welt end of the first hose on the first carrier, to remove the first hose therefrom, to transfer it to the former and to mount it in an encircling position thereon; and said conveying means being arranged to deliver the everted second hose into a space temporarily formed between the first hose and one face of the former.

14. A machine according to claim 13, further comprising means to hold the former in operative juxtaposition to said first carrier, said transfer means being arranged to transfer the first hose onto both the fromer and said holding means so that the said hose encircles both, and the holding means including a hollow body configured to create said space between the first hose and said former.

15. A machine according to claim 14, wherein said hollow body is connected to said conveying means, which delivers the second hose into the interior of said body.

16. A machine according to claim 14, further including means to grip an end of said former and the first hose, said gripping means and holding means being relatively movable to disengage the holding means from the encircling first hose such that the latter slips from the holding means and closely encircles the former.

17. A method of finishing and packaging a pair of hose comprising:

(a) internally supporting a pair of hose on two hose carriers received on a hosiery processing machine;
(b) moving a flat former into operative juxtaposition with one of said carriers with a hose support thereon;
(c) transferring said hose from said one of said carriers onto said flat former in a laterally stretched state;
(d) thereafter dismounting said other hose from said other of said carriers; and
(e) inserting said second hose into a space located between said first hose and said flat former.

18. A method according to claim 17 wherein said flat former is moved into end-to-end alignment with said one of said carriers and said hose is transferred from said one of said carriers by stripping said hose from said carrier in a direction toward said flat former and drawing same onto said former while everting said hose.

19. A method according to claim 17, wherein said former is engaged by a holding means therefor and said first hose is drawn over the holding means and the former, said holding means including a hollow body configured to create said space between a layer of said first hose and said former, the second hose is delivered into said hollow body and said space, and thereafter the former is disengaged from said holding means in such a manner that said first hose encircling the holding means slips therefrom and closely encircles said former.

20. A method according to claim 19, comprising disengaging the former from said holding means by clamping and immobilizing an end of said former whereat a toe end of the first hose is located, and moving said holding means away from said end of the former.

* * * * *